United States Patent [19]

Thomas

[11] 3,952,429

[45] Apr. 27, 1976

[54] SECTIONAL SHOE MID-SOLE

[75] Inventor: Dwight L. Thomas, Blanchester, Ohio

[73] Assignee: Vulcan Corporation, Cincinnati, Ohio

[22] Filed: Jan. 13, 1975

[21] Appl. No.: 540,720

[52] U.S. Cl. ..... 36/31; 36/33
[51] Int. Cl.[2] ..... A43B 13/14
[58] Field of Search ..... 36/31, 33

[56] References Cited

UNITED STATES PATENTS

| | | | |
|---|---|---|---|
| 1,136,253 | 4/1915 | Merrow | 36/31 |
| 2,290,390 | 7/1942 | Stewart | 36/33 |
| 2,361,511 | 10/1944 | Stritter | 36/31 |
| 2,543,183 | 2/1951 | Maling | 36/31 X |

FOREIGN PATENTS OR APPLICATIONS

| | | | |
|---|---|---|---|
| 1,117,586 | 2/1956 | France | 36/31 |
| 323,031 | 12/1934 | Italy | 36/33 |

*Primary Examiner*—Alfred R. Guest
*Attorney, Agent, or Firm*—Walter S. Murray

[57] ABSTRACT

A composite mid-sole especially adapted for incorporation into platform shoes and consisting of a rigid heel and shank part interconnected with a flexible forepart. The mid-sole parts are composed of moldable plastic material of differing densities, the composite mid-sole being a unit to be lasted to a shoe upper and a shoe outsole in a subsequent manufacturing operation. An improved fastening means conjoining the heel and shank part to the forepart of the mid-sole is disclosed.

2 Claims, 4 Drawing Figures

Fig. 1
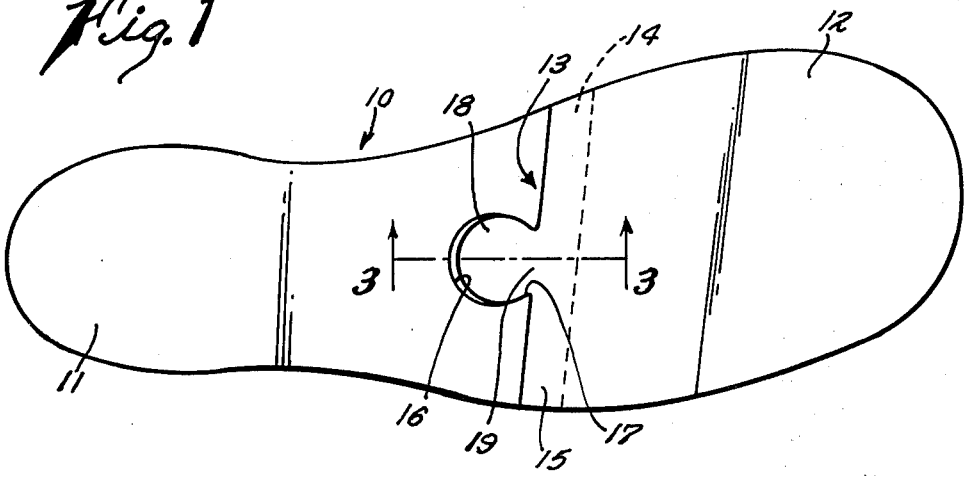
Fig. 2
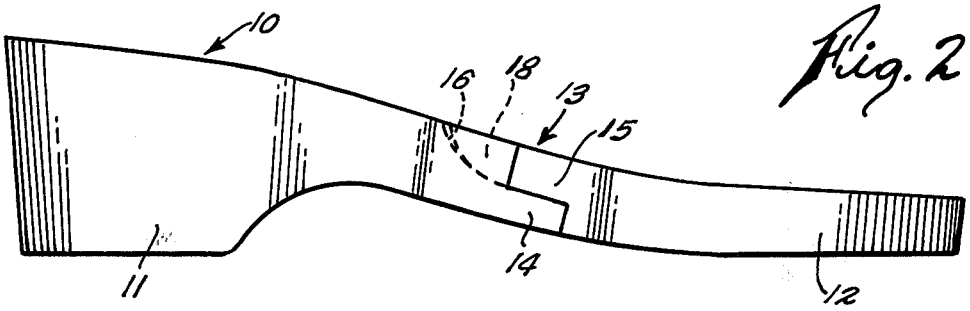
Fig. 3
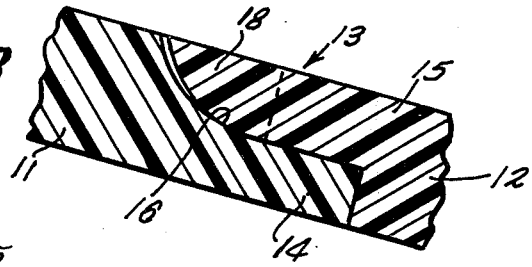
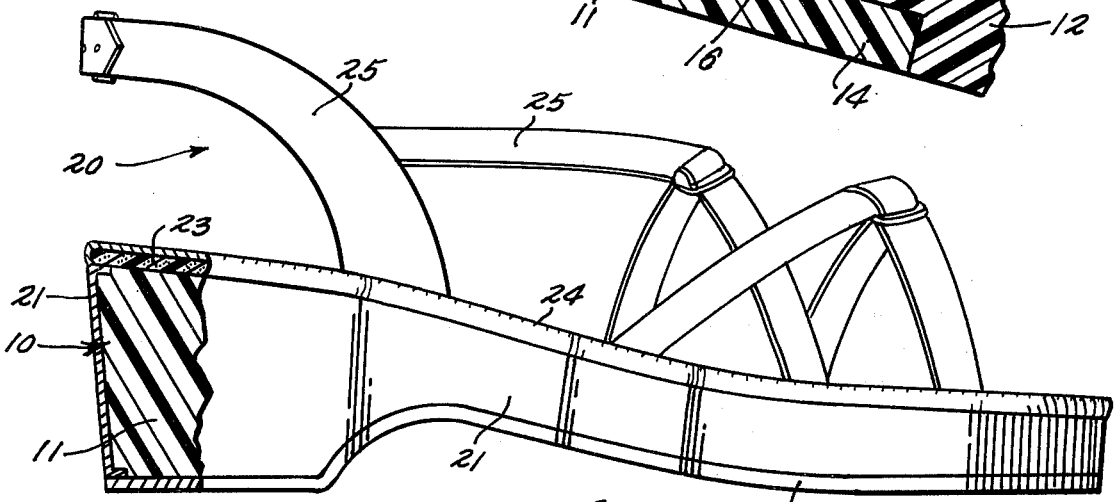
Fig. 4

SECTIONAL SHOE MID-SOLE

This invention relates to improvements in shoe making and is particularly directed to a novel mid-sole structure for a style of footwear, commonly referred to as a "platform" shoe.

Conventionally platform shoes are given a unitary, rigid heel and shank part and an insole bonded to the heel seat and shank and extending forwardly to form the forepart. This construction requires a separately molded heel and shank part for each shoe model and its many sizes together with a separately formed insole composed of soft and highly flexible material resultes in a shoe having undesirable forepart characteristics. Other platform shoe insoles have heel, shank and foreparts composed of rigid material which presents a completely inflexible shoe that cannot flex with the natural movements of the wearer's feet.

It is therefore the main object of this invention to provide a sectional mid-sole particularly adapted for incorporation into "platform" shoe constructions and which has a rigid heel and shank part and a flexible forepart, said parts being permanently conjoined to provide a unitary mid-sole to which an insole and outsole may be lasted in a subsequent shoe making operation.

Another object of the invention is to provide a mid-sole having interfitted heel part and foreparts composed of moldable plastic materials having different densities, such that mid-soles having a range of flexure characteristics can be supplied from a set of molds.

A further object of the invention is to provide a sectional mid-sole wherein the heel part and forepart are connected by a standardized joint structure whereby mid-soles will have parts that are interchangeable as to heel part heights and/or styles with forepart sizes and toe styles.

A still further object of this invention is to provide a mid-sole which secures greater comfort and support to the feet of wearers of "platform" shoes in that such shoes are of lightweight, yet firmly support the wearer's heel weight while securing natural flexibility to the toes of the wearer's feet.

These and other features of the invention will be more fully understood by reference to the accompanying drawings, wherein:

FIG. 1 is a top plan view of the shoe mid-sole of this invention.

FIG. 2 is a side elevational view of the mid-sole shown in FIG. 1.

FIG. 3 is an enlarged, fragmental section taken on line 3—3 of FIG. 1.

FIG. 4 is a side elevational view of a "platform" shoe with the mid-sole of this invention positioned therein, parts being broken away and shown in section.

With reference to FIGS. 1–3 of the drawings the sectional mid-sole of this invention is generally indicated by the numeral 10, said mid-sole consisting of a one-piece heel and shank part 11, a forepart 12 conjoined by a fastener means 13.

The heel and shank part 11 is composed of a rigid, moldable plastic material such as a lightweight, rigid urethane and the forepart 12 is composed of a flexible, moldable urethane plastic material.

The fastening means 13 securing the heel and shank part to the forepart to provide a unitary mid-sole for slip-lasted "platform" shoes consists of a relatively thin inset shelf 14 formed on the laterally extending forward edge of the heel and shank part 11 and a laterally extending, thin lip 15 formed on the rear edge of the forepart 12, said shelf and lip being disposed in overlapping relationship and the total thickness of the shelf 14 and the lip 15 equaling the thickness of the mid-sole 10 at the fastening means thereby providing smooth upper and lower faces for the mid-sole.

As best shown in FIGS. 1 and 3 the fastening means 13 includes a socket 16 molded into the upper face of the heel and shank part 11 and which is provided with a laterally restricted mouth 17 (FIG. 1) that opens out into the shelf 14. The forepart 12 has a tongue 18 that conforms to the configuration of the socket 16 in the heel and shank part, said tongue being connected to the forepart by a laterally restricted neck 19 that fits into the mouth 17 of the socket 16. When the tongue 18 is interfitted with the socket 16 a strong connection is formed between the mid-sole parts precluding separation of the parts when the mid-sole is incorporated into a "platform" shoe.

The mid-sole parts 11 and 12 may be permanently secured together by adhesive or cement applied between the abutting surfaces of the fastening means 13, or other securing means, such as staples, may be employed, if desired.

It will therefore be understood that I have provided a composite, unitary mid-sole which is rugged, yet light in weight and has a construction susceptible to the interchange of parts thus reducing the number of heel and forepart molds required to produce the model and sizes of mid-soles for a line of "platform" shoes.

In FIG. 4 of the drawings the mid-sole 10 is depicted as embodied in a platform shoe 20 of otherwise conventional structure, the illustrated shoe including a leather or composition cover 21 cemented to the side of the mid-sole 10, an outsole 22 being lasted to the bottom face of the mid-sole in a well known manner. An insole 23, preferably made of a foam plastic material, is covered with a sock lining 24 and is lasted to the upper face of the mid-sole along with a suitable upper, such as a series of foot engaging straps 25 secured to the mid-sole in a known manner.

The foregoing description and the accompanying drawings are illustrative of the invention, it being understood that changes in the style of shoe, the forms of the several parts, or the substitution of equivalent elements which are readily apparent to one skilled in the art may be made without a departure from the spirit of this invention, the scope thereof being limited by the appended claims.

What is claimed is:

1. A mid-sole for use in the construction of footwear comprising a one-piece heel and shank part composed of a rigid, moldable material, a lateral shelf formed on the forward edge portion of the heel and shank part, a socket molded into the upper surface of the heel and shank part and having a restricted mouth opening onto the shelf, a forepart composed of a flexible, moldable material, a lateral, downwardly facing lip formed on the rear edge portion of the forepart interfitted with the shelf on the heel and shank part, a tongue connected to the rear edge of the forepart by a restricted neck, said tongue and neck on the forepart respectively interfitting with the socket and mouth on the heel and shank part to form a connection between the mid-sole parts.

2. A mid-sole as set forth in claim 1 wherein the interfitted parts are permanently bonded together at the interfitted mid-sole parts.

* * * * *